US012578098B2

(12) United States Patent
Neukamm et al.

(10) Patent No.: US 12,578,098 B2
(45) Date of Patent: Mar. 17, 2026

(54) COMBINATION APPLIANCE COMPRISING A COOKING HOB AND AN EXTRACTION DEVICE

(71) Applicant: ELECTROLUX APPLIANCES AKTIEBOLAG, Stockholm (SE)

(72) Inventors: Alwin Neukamm, Rothenburg ob der Tauber (DE); Juergen Leikam, Rothenburg ob der Tauber (DE); Simone Probst, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 353 days.

(21) Appl. No.: 18/039,224

(22) PCT Filed: Nov. 19, 2021

(86) PCT No.: PCT/EP2021/082319
§ 371 (c)(1),
(2) Date: May 27, 2023

(87) PCT Pub. No.: WO2022/117367
PCT Pub. Date: Jun. 9, 2022

(65) Prior Publication Data

US 2024/0003549 A1 Jan. 4, 2024

(30) Foreign Application Priority Data

Dec. 3, 2020 (EP) ..... 20211483

(51) Int. Cl.
*F24C 15/20* (2006.01)

(52) U.S. Cl.
CPC ..... *F24C 15/2042* (2013.01); *F24C 15/2085* (2013.01)

(58) Field of Classification Search
None
See application file for complete search history.

(56) References Cited

U.S. PATENT DOCUMENTS 3,880,061 A * 4/1975 Hensiek ..... B08B 15/00 55/DIG. 29
4,766,880 A * 8/1988 von Blanquet ..... F24C 15/2042 126/299 D (Continued)

FOREIGN PATENT DOCUMENTS

DE 102013016080 4/2015
DE 102016207087 A1 * 10/2017 ..... F24C 15/2042

(Continued)

OTHER PUBLICATIONS

International Search Report and Written Opinion for PCT/EP2021/082319, dated Mar. 3, 2022, 8 pages.

(Continued)

*Primary Examiner* — Jorge A Pereiro
(74) *Attorney, Agent, or Firm* — Chrisman Gallo Tochtrop LLC

(57) ABSTRACT

The present invention is related to a combination appliance (10) comprising a cooking hob (12), which comprises a cover plate or work top (18) and an extraction device (14). The extraction device (14) comprises—a suction opening (24, 32) arranged above the cooking hob (12), —a fan (36) for sucking air from the area above the cooking hob (12), —a filter element (42) for removing particles and/or odours from the air sucked in, and—an outlet opening (28, 34) for exhausting air. According to the invention, the direction of the sucked air comprises an at least major horizontal component and the outlet opening (28, 34) is arranged above the cooking hob (12).

5 Claims, 3 Drawing Sheets

(56) References Cited

U.S. PATENT DOCUMENTS

| | | | | |
|---|---|---|---|---|
| 2018/0073745 | A1* | 3/2018 | Norman | F24F 7/04 |
| 2018/0255967 | A1 | 9/2018 | Haas et al. | |

FOREIGN PATENT DOCUMENTS

| | | | | |
|---|---|---|---|---|
| DE | 102016116734 | | 3/2018 | |
| DE | 102016116734 | A1 * | 3/2018 | F24C 15/20 |
| DE | 102017216456 | | 3/2019 | |
| DE | 102018200764 | | 7/2019 | |
| EP | 2444739 | A2 * | 4/2012 | F24C 15/2042 |
| EP | 2581668 | A1 * | 4/2013 | F24C 15/2042 |
| JP | H09264543 | | 10/1997 | |
| KR | 102055196 | B1 * | 12/2019 | A61L 9/00 |
| WO | 2020002456 | | 1/2020 | |

OTHER PUBLICATIONS

European Communication for application No. 20211483.1 dated Feb. 12, 2025, 12 pages.

* cited by examiner

COMBINATION APPLIANCE COMPRISING A COOKING HOB AND AN EXTRACTION DEVICE

During the performance of cooking activities under use of a cooking hob, cooking vapours are generated, which are distributed over the cooking area. In order to avoid these cooking vapours to be spread throughout the entire kitchen space, an arrangement of an extraction device, particularly an extractor hood, is common. Said extraction device is operated in parallel to the cooking hob, thereby sucking in these cooking vapours in order to filter out particles and tiny droplets from the vapours and/or to blow the vapours to the outside of the building. While it has been common use to arrange such an extractor hood above the cooking area, in recent years downdraft extraction devices have been finding a growing market. Such kind of extraction device is usually arranged below a worktop of the related cooking hob and it comprises at least one fan for sucking air from the cooking area through an opening or recess arranged in the worktop. In such systems, the air is moved through a ventilation channel from the cooking zone to the bottom of a kitchen cabinet, where it is blown out and returned to the ambient air. Due to the provision of a ventilation channel inside of the related kitchen cabinet, storage space for e. g. cookware or other utensils is blocked. Furthermore, the functionality of such extraction devices is reduced, when high pots are used for the cooking process, because of the particular distance from the source of cooking vapours to the suction opening, which is on the same level as the worktop of the cooking hob.

It is an object of the present invention to provide a combination appliance comprising a cooking hob and an extraction device, which is configured for extracting cooking vapours without occupying relevant storage space and without losing performance, when high pots are used for the cooking process.

A combination appliance includes a cooking hob and an extraction device. The cooking hob comprises a cover plate or worktop, in particular a glass plate. The extraction device comprises

- a fan for sucking air from the area above the cooking hob through a suction opening of the extraction device,
- a filter element for removing particles and/or odours from the air sucked in, and
- an outlet opening for exhausting air.

The exhausted air is specifically blown out into the ambient air. According to the present invention, the direction of the sucked air comprises an at least major horizontal component and the outlet opening is arranged above the cooking hob. The filter element particularly includes a grease and/or odour filter function and/or is preferably arranged or arrangeable upstream of the fan.

The expression "an at least major horizontal component" may also include a building-up of an approximately horizontal airflow.

Inside the extraction device particularly an air channel is formed. Specifically, said air channel extends from the suction opening to the outlet opening, so that the entire extraction device may be traversed by the air channel.

Preferably, the extraction device is moveable in a vertical direction, so that preferably the extraction device is positioned on the worktop of the cooking hob in an on-mode and positioned below or flush mounted with the worktop of the cooking hob in an off-mode. This means that the extraction device is retractable dependent on the use of the cooking hob. If the extraction dew vice is being turned on, then it will be moved automatically or has to be moved manually from below the worktop of the cooking hob to the top of the worktop of the cooking hob. If the extraction device is then again turned off, then it can be moved automatically or manually from the top of the worktop of the cooking hob below the worktop of the cooking hob. This means, that particularly the extraction device is moveable automatically or manually.

In a further preferable embodiment, the extraction device is fixed, favourably releasably fixed, to the worktop. This means that the extraction device is not integrated in the cooking hob, instead it is a separate device, which can be positioned on the worktop of the cooking hob. The extraction device is therefore removable from its attachment position on the worktop by simply detaching it from the worktop.

In order to provide a particularly direct and strong intake of the air, notably vapours originating from cooking, specifically when cooking with an uncovered or only partly covered pot, the suction opening of the extraction device may be arranged at a level of a rim of a usual pot, which is positioned or positionable on a cooking zone of the cooking hob. As a reference, a standard mid-size pot may be a base for defining the level for the arrangement of the suction opening.

A specific embodiment provides for an extraction device with the suction opening, which is arranged at a first side, and with an outlet opening, which is arranged at a second side of the extraction device. Preferably, the first and second sides are opposite sides of an extraction device having a cuboid housing.

The extraction device of the combination appliance may be characterized by an at least approximately horizontal suction direction and an at least approximately horizontal blow-out direction. In this case, the outlet opening is arranged at a level different to the level of the suction opening. An arrangement of the outlet opening lower than the suction opening may be favourable in order to keep the entire structure of the extraction device as low or small as possible.

One embodiment, specifically different to the just described one, provides for an outlet opening, which is arranged on a top side of the extraction device. In case of a lateral arrangement of the suction opening, a deflection of the airstream, particularly by 90 degrees, is implemented in the extraction device.

The extraction device may comprise a cylindrical housing and the suction opening may be a circumferential slot at a cylinder barrel surface. Preferably, the suction opening is positioned at an upper cylinder barrel surface, which is advantageous in order to be consistent with an arrangement at a level of a standard pot rim.

One specific embodiment of the present invention provides for an extraction device, which is arranged in a centre area of the cooking hob. It may be configured to suck air from the cooking hob sections, specifically from all cooking hob sections, on which cooking zones are accommodated.

Another specific embodiment of the present invention is characterized by an arrangement of the extraction device on the cooking hob with a specific assignment to one cooking zone or to a part of the total number of cooking zones. The extraction device is preferably split into two extraction device units, particularly with smaller dimensions and/or with lower performances.

Alternatively, the dimensions and/or performances may be kept on an unchanged level, with the result of an increase of the total performance with the two extraction device units involved.

According to one embodiment, the airflow in the interior of the extraction device or the extraction device unit at least in the area of arrangement of the fan is in vertical direction. The fan specifically moves the air vertically in a straight line.

The filter element may be a panel filter arranged in horizontal alignment. That way, the air may pass through the filter element is a direction substantially orthogonally to the filter surface. This is particularly in line with the general airflow in this passage.

One specific embodiment of the method according to the present invention provides for an extraction device, which is controllable by remote control means. Alternatively, control elements arranged at the combination appliance may be considered for the control of the extraction device. The control elements are preferably included in a common user interface with control elements for the cooking hob. This is favourable with respect to a simple operation by the user because of all relevant control elements for the cooking process being positioned close to each other. Moreover, the control elements and a related control unit of the combination appliance may include a hob-to-hood function configured to operate the fan of the extraction device in dependence of any status of the cooking hob or any parameter provided to the cooking hob, in particular any power level set by the user for operating a cooking zone. Control signals from a control unit to the extraction device are particularly transmitted by wire or wireless means.

For cleaning or replacing purposes, the filter element may be removable from the extraction device or the extraction device unit and/or the entire extraction device may be removable or detachable from the cooking hob. A used filter may be cleaned, e. g. in a dishwasher, or even replaced after its removal from the housing of the extraction device. Also the entire extraction device or the extraction device unit, or more specifically its housing, may be detachable from the cooking hob, in particular detachable from the worktop thereof. Also this component may be subject to a cleaning process, e. g. in a dishwasher.

In a preferred embodiment, wherein the extraction device represents a separate device, the extraction device or the extraction device unit favourably includes a power supply unit, which comprises at least one rechargeable battery. As an alternative, contactless energy transfer means may be implemented. Said contactless energy transfer means are in particular capacitive or inductive coupling means.

The fan used for sucking the air from the cooking zones is particularly an axial or a radial fan. Notably in the case of a cuboid housing, the fan may be a tangential fan.

Novel and inventive features of the present invention are set forth in the appended claims.

The present invention will be described in further detail with reference to the drawings, in which FIG. 1 illustrates schematically a perspective view of a first embodiment of a combination appliance including a cooking hob and a first example of an extraction device;

In all figures the same or equivalent part are marked with the same reference numbers.

Figure 1:
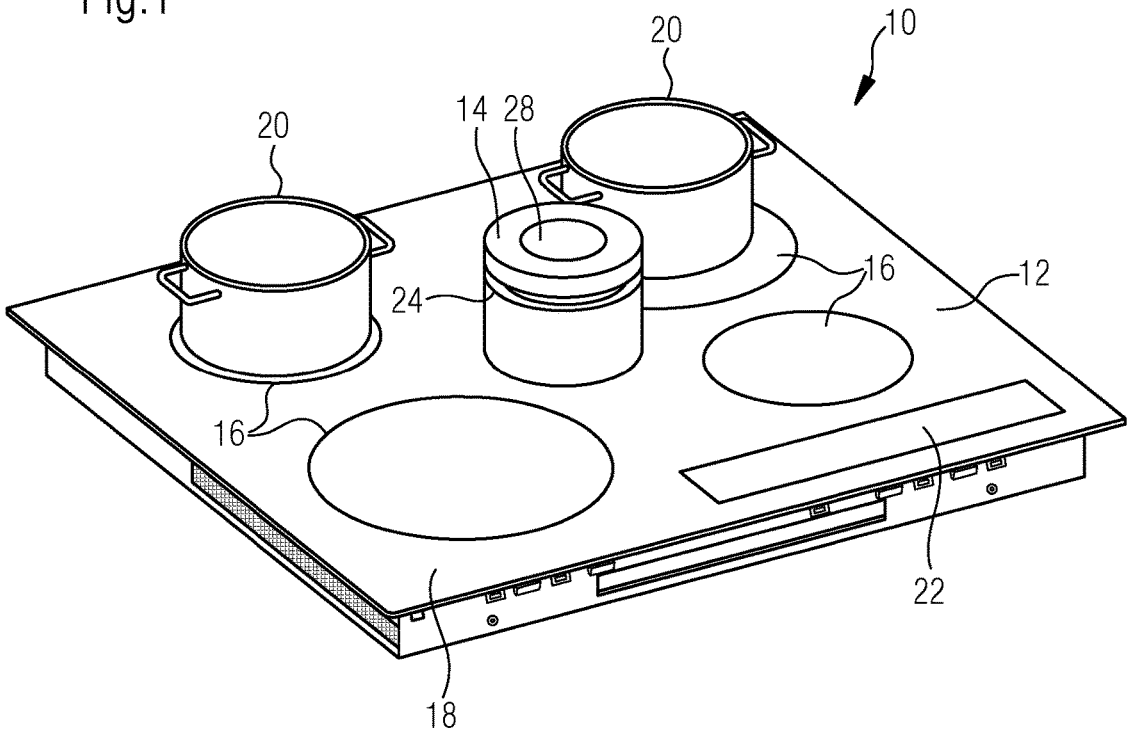
Figure 2:
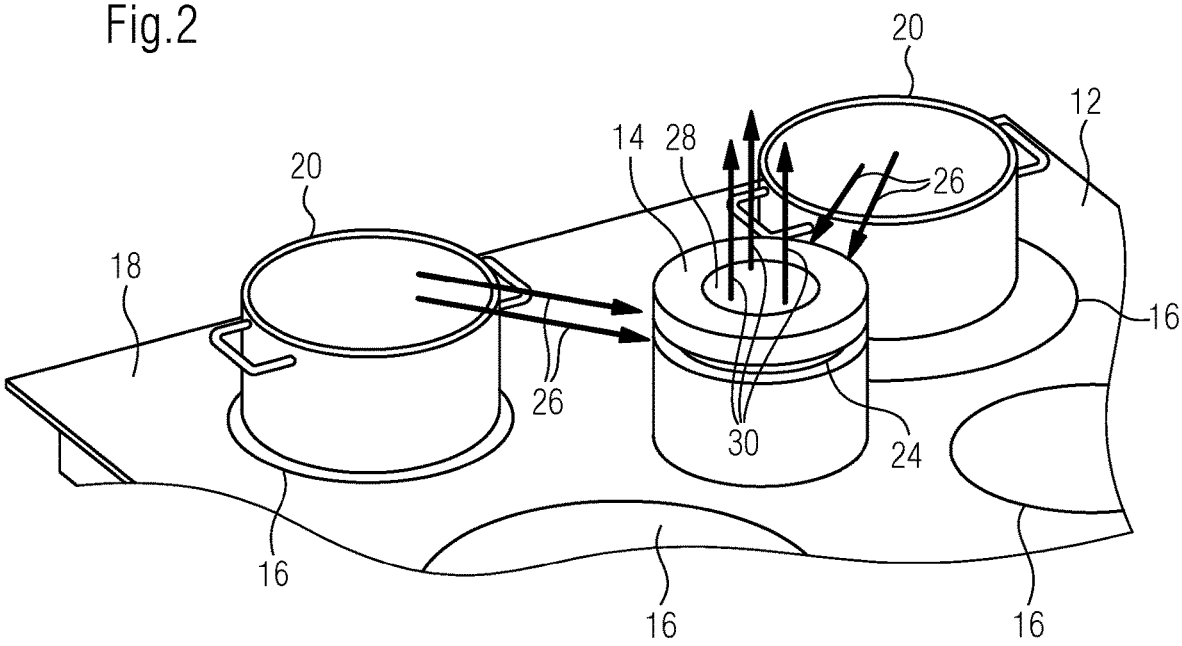
FIG. 2 is an enlarged view of a section of the combination appliance of FIG. 1 with an airflow indication.

FIGS. 1 and 2 illustrate schematically a combination appliance 10 according to a first example comprising a cooking hob 12 and an extraction device 14. The cooking hob 12 is designed to be installed in a cutout of a kitchen countertop. The extraction device 14 is configured to take away cooking vapours occurring during cooking processes, in particular when cooking with uncovered cookware takes place. The cooking hob 12 comprises four cooking zones 16 indicated by circles imprinted on a worktop 18 of the cooking hob 12. Cookware is placeable on the cooking zones 16 for performing the cooking process, indicated by pots in the figures.

The cooking zones 16 are heated by means of heating elements (not shown) arranged underneath and close to the worktop 18. Said heating elements may be of electric nature as indicated in the figures, but other heating systems like gas cooking elements are considerable as well. One preferred cooking solution is induction cooking and, respectively, the heating elements are induction coils.

Figure 3:
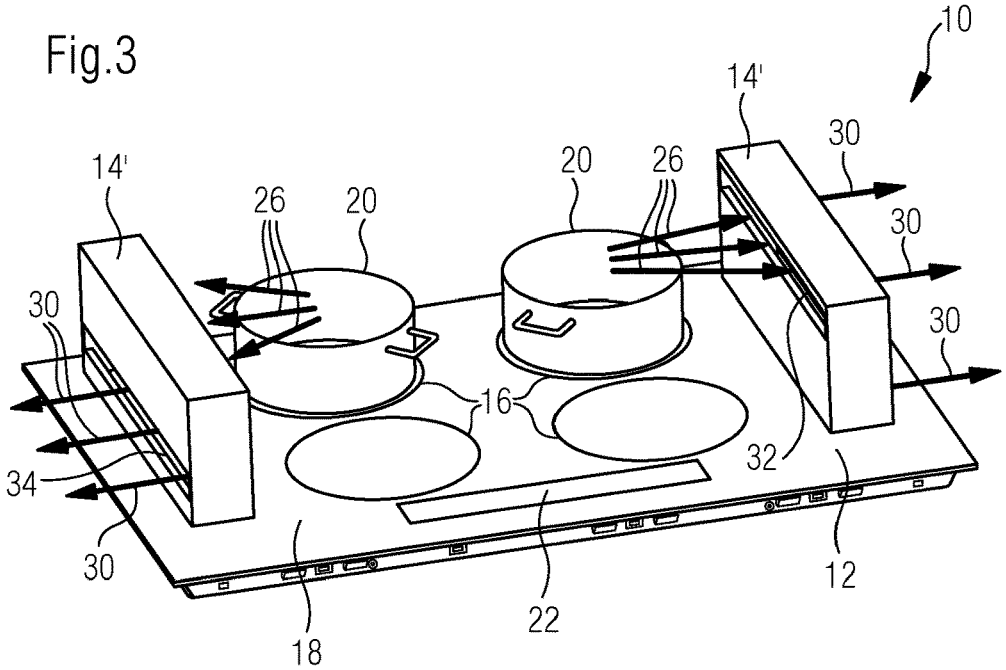
FIG. 3 illustrates schematically a perspective view of a second embodiment of a combination appliance including a cooking hob and a second example of an extraction device split into two units.

The cooking hob 12 is operable by a user of the combination appliance by means of a user interface 22, which is arranged at a front edge of the worktop 18, either laterally arranged as in FIG. 1 or centrally arranged as in FIG. 3. The user interface 22 may include any types of control units for providing control inputs to a control unit of the cooking hob 12. The present example is characterized by touch control elements and the control inputs are provided by the user on a touch surface of the user interface 22.

The extraction device 14 of the present invention is a vertical moveable unit, i. e. the extraction device 14 is arranged on the top side of the worktop 18.

According to the first example of FIGS. 1 and 2, the extraction device 14 is arranged in a central position of the worktop surface, which is also in the midst of and the closest position to all four cooking zones 16. In this position, the extraction device 14 is capable of sucking cooking vapours originating from cooking processes, in particular when cooking with uncovered pots 20, as illustrated in the figures. In order to take in the cooking vapours using the shortest possible route, the extraction device 14 comprises a cylindrical housing and the suction opening is a circumferential slot 24 at the cylinder barrel of the housing surface. Advantageously, the circumferential slot is positioned at an upper region of the cylinder barrel surface, namely at a height that corresponds with the rim of a standard pot, which is illustrated by the two pots 20 shown in FIGS. 1 and 2. As presented by the arrows 26 in FIG. 2, the sucked air, i. e. the cooking vapours, is moved from the pot rim to the slot 24 in nearly horizontal direction, which is the shortest way in this case. The air flows through the interior of the extraction device 14 passing a filter in a similar way as it will be explained in detail further down below with reference to the second example of the extraction device 14' according to the present invention. In any case, the filtered air is blown out to the ambient air through an outlet opening 28 arranged on a top side of the extraction device 14. The blow-out direction is vertical, which is orthogonally to the horizontal top side, illustrated by respective arrows 30 for blown-out air.

Figure 4:
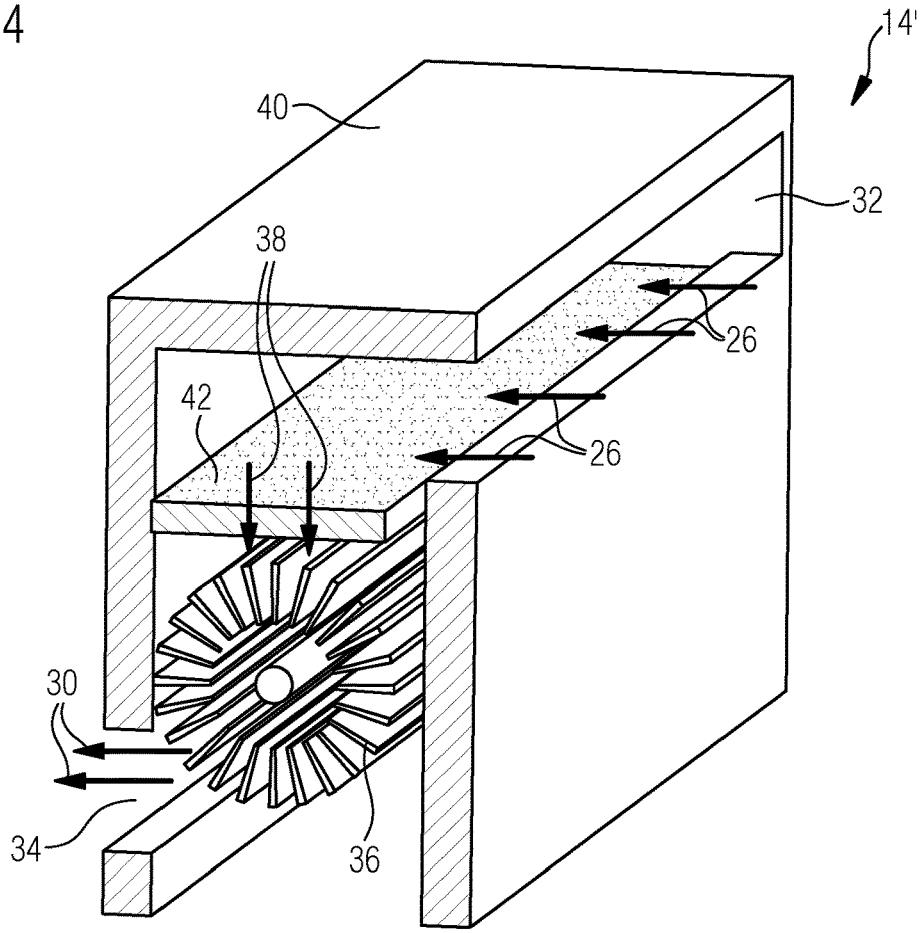
FIG. 4 illustrates a cross-sectional view of the extraction device of the combination appliance of FIG. 3 with an airflow indication.
Figure 5:
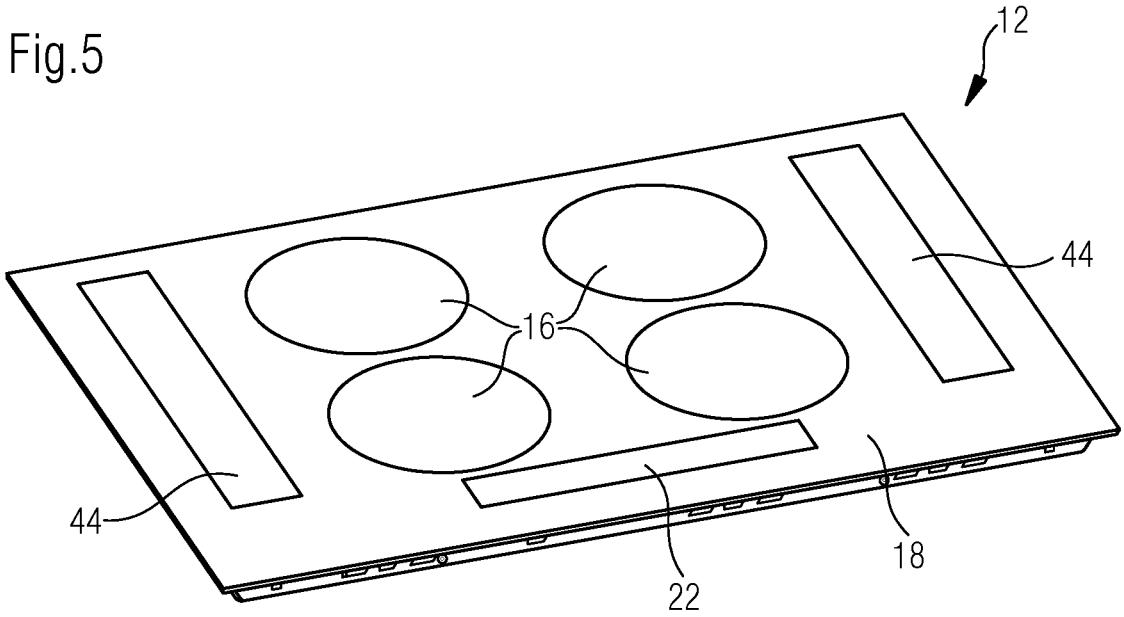
FIG. 5 is an isolated illustration of the cooking hob of the combination device of FIG. 3.

With reference to FIGS. 3 to 5, the already mentioned second example for the combination appliance 10, more specifically for the extraction device, will now be described.

Contrary to the extraction device 14 of the first example above, the extraction device of the second example is not arranged in a central position of the worktop 18 of the cooking hob 12. In fact, the extraction device of the second example is split into two extraction device units 14', which are arranged at the left and right lateral edges of the worktop 18 and which are in a mirror-inverted arrangement. The left one of the extraction device units 14' is allocated to the two left cooking zones 16, and the right one of the extraction device units 14' is allocated to the two right cooking zones 16, what means that the cooking vapours of a cooking zone 16 are sucked in from the respectively allocated one of the extraction device units 14', which is also the closest one to the allocated cooking zones 16.

The extraction device units 14' of the second example comprise a cuboid housing. The side wall of the housing of each extraction device unit 14', which side wall is facing the allocated cooking zone 16, includes a horizontal intake groove 32 forming the suction opening of the extraction device unit 14'. In the same way as with the circumferential slot 24 in the first example, the horizontal groove 32 is arranged in a similar level as a rim of a mid-size pot 20, so that the flow of the sucked-in cooking vapours is nearly horizontal. The blown-out air (see arrows 30) leaves the cuboid housing of the extraction device unit 14' through a horizontal outlet groove 34 of the side wall facing away from the allocated cooking zones 16. Contrary to intake groove 32, the outlet groove 34 is arranged close to the bottom of the extraction device unit 14', which is therefore at a lower level.

As illustrated by FIG. 4, which is a cross-sectional view of the extraction device unit 14' of the second example of the combination appliance 10, the flow of the sucked-in cooking vapours through the extraction device unit 14' is driven by the operation of an extraction fan 36 arranged inside of the cuboid housing. Said extraction fan 36 is a tangential fan extending over nearly the entire width of the cuboid housing.

The course of the cooking vapours from the cooking area through the extraction device 14 to a re-entry into ambient air is illustrated in FIG. 4 by arrows 26, 30, 38. Due to the operation of the extraction fan 36, the cooking vapours are sucked in through the horizontal intake groove 32, which is arranged directly below the top wall 40 of the cuboid housing, following the arrows 26 for sucked-in air. After entering the cuboid housing, the airflow is deflected by 90 degrees to a vertical downwards direction, thereby following the arrows 38 for internal airflow and passing the blades of fan 36. At the bottom side of the cuboid housing the airflow is deflected again by 90 degrees, this time from the vertical direction to a horizontal one, namely towards the horizontal outlet groove 34 through which the air is blown out, following the arrows 30 for blown-out air and returning to the ambient air.

On their way through the extraction device unit 14', the cooking vapours pass through a flat filter element 42, which is arranged downstream behind the horizontal intake groove 32, but upstream the extraction fan 36. The filter element 42 is mainly configured to filter out grease particles, but also a layer capable of filtering out odours may be included.

The filter element 42 is removable from its place inside the cuboid housing for cleaning purposes or for its replacement. Moreover, in FIG. 5 the extraction device units 14' are positioned flush-mounted at the worktop 18 of the cooking hob 12. In this embodiment each top surface 44 of the extraction device units 14' is made of the same material as the worktop of the cooking hob 12 is made of.

Although illustrative embodiments of the present invention have been described herein with reference to the accompanying drawings, it is to be understood that the present invention is not limited to these precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 combination appliance
12 cooking hob
14 extraction device
14' extraction device units
16 cooking zones
18 worktop
20 pots
22 user interface
24 circumferential slot
26 arrows for sucked-in air
28 outlet opening
30 arrows for blown-out air
32 horizontal intake groove
34 horizontal outlet groove
36 extraction fan
38 arrows for internal airflow
40 top wall
42 filter element
44 top surface

The invention claimed is:

1. A combination appliance comprising a cooking hob having worktop defining a first cooking zone and a second cooking zone, each said cooking zone adapted to support a cooking pot for cooking; and a vertically movable first extraction device extendable through a first opening in said worktop adjacent to the first and second cooking zones between an off-mode position in which the first extraction device is flush with the worktop and an on-mode position in which the first extraction device extends above the worktop; the first extraction device comprising:

a first suction opening disposed at a height corresponding to a rim of a pot when received in either the first cooking zone or the second cooking zone, thereby defining a substantially horizontal path for sucked air from pots in the first and second cooking zones into said first suction opening;

a first filter located downstream of said suction opening relative to a first airflow path through the first extraction device;

a first fan located downstream of said filter relative to said first airflow path; and a first outlet opening located downstream of said first fan relative to said first airflow path adapted to discharge air from the first airflow path into an ambient environment, wherein the first suction opening is arranged at a first side and the first outlet opening is arranged at a second side of the first extraction device opposite to the first side, such that the first suction opening and first outlet opening face opposite directions.

2. The combination appliance of claim 1, said first extraction device comprising a cylindrical housing, said first opening in said worktop being circular and adapted to accommodate the cylindrical housing therethrough.

3. The combination appliance of claim 1, the worktop further defining a third cooking zone and a fourth cooking zone adapted to support respective cooking pots for cooking; the appliance further comprising a vertically movable second extraction device extendable through a second opening in said worktop adjacent to the third and fourth cooking zones between an off-mode position in which the second extraction device is flush with the worktop and an on-mode position in which the second extraction device extends above the worktop; the second extraction device comprising:

a second suction opening disposed at a height corresponding to a rim of a pot when received in either the third cooking zone or the fourth cooking zone, thereby defining a substantially horizontal path for sucked air from pots in the third and fourth cooking zones into said second suction opening;

a second filter located downstream of said second suction opening relative to a second airflow path through the second extraction device;

a second fan located downstream of said second filter relative to said second airflow path; and a second outlet opening located downstream of said second fan relative to said second airflow path adapted to discharge air from the second airflow path into the ambient environment;

wherein said first and second cooking zones are disposed in a left side of the worktop and said third and fourth cooking zones are disposed in a right side of the worktop, said first and second extraction devices being arranged at left and right lateral edges, respectively, the first and second outlet openings both facing and configured to discharge air away from the hob, each being at a lower height than the respective first and second suction openings.

4. The combination appliance of claim 1, said extraction device being separable from the hob and further comprising a dedicated power supply, said dedicated power supply being selected from among a rechargeable battery and contactless energy transfer means.

5. The combination appliance according to claim 1, wherein the first and second sides of the first extraction device are opposite sides of a cuboid housing.

* * * * *